US011052283B2

(12) United States Patent
An

(10) Patent No.: US 11,052,283 B2
(45) Date of Patent: Jul. 6, 2021

(54) HAND GRIP

(71) Applicant: Tae Jin An, Incheon (KR)

(72) Inventor: Tae Jin An, Incheon (KR)

( * ) Notice: Subject to any disclaimer, the term of this patent is extended or adjusted under 35 U.S.C. 154(b) by 0 days.

(21) Appl. No.: 16/879,315

(22) Filed: May 20, 2020

(65) Prior Publication Data

US 2020/0368577 A1 Nov. 26, 2020

(30) Foreign Application Priority Data

May 22, 2019 (KR) ..... 10-2019-0060259

(51) Int. Cl.

| | |
|---|---|
| ***A63B 23/16*** | (2006.01) |
| ***A63B 21/00*** | (2006.01) |
| ***A63B 21/04*** | (2006.01) |
| ***A63B 21/05*** | (2006.01) |
| ***A63B 21/02*** | (2006.01) |

(52) U.S. Cl.

CPC ..... *A63B 23/16* (2013.01); *A63B 21/0004* (2013.01); *A63B 21/00069* (2013.01); *A63B 21/023* (2013.01); *A63B 21/0407* (2013.01); *A63B 21/05* (2013.01)

(58) Field of Classification Search

CPC ..... A63B 23/16; A63B 21/026; A63B 21/0407–0435; A63B 21/05

See application file for complete search history.

(56) References Cited

U.S. PATENT DOCUMENTS 7,824,311 B1 * 11/2010 Hsu ..... A63B 21/023 482/49
2008/0103026 A1 * 5/2008 An ..... A63B 21/023 482/49
2015/0290491 A1 * 10/2015 An ..... A63B 21/023 482/49
2019/0366145 A1 * 12/2019 Reda ..... A63B 23/16
2020/0376333 A1 * 12/2020 An ..... A63B 21/00069

FOREIGN PATENT DOCUMENTS

| | | | |
|---|---|---|---|
| CN | 207253661 | U | 4/2018 |
| KR | 20070006256 | A | 1/2007 |
| KR | 100760083 | B1 | 9/2007 |
| KR | 20100013805 | A | 2/2010 |
| KR | 101355679 | B1 | 2/2014 |

OTHER PUBLICATIONS

Office Action issued in corresponding KR Application No. 10-2019-0060259 with partial English translation dated May 20, 2020 (8 pages).

* cited by examiner

*Primary Examiner* — Jennifer Robertson

(74) *Attorney, Agent, or Firm* — Osha Bergman Watanabe & Burton LLP

(57) ABSTRACT

The present invention relates to a hand gripper including a first arm, a second arm, a pair of spring members, a first spring member coupling shaft, and a second spring member coupling shaft, wherein a plurality of first elastic force adjusting grooves and a plurality of second elastic force adjusting grooves, to which the first spring member coupling shaft and the second spring member coupling shaft are selectively coupled, respectively, to adjust strength of elastic force provided by the spring members, are formed in a first body of the first arm and a second body of the second arm, respectively.

6 Claims, 10 Drawing Sheets

HAND GRIP

CROSS-REFERENCE TO RELATED APPLICATION

This application claims priority to and the benefit of Korean Patent Application No. 2019-0060259, filed on May 22, 2019, the disclosure of which is incorporated herein by reference in its entirety.

BACKGROUND

1. Field of the Invention

The present invention relates to a hand gripper, and more particularly, to a hand gripper including a pair of operating arms and providing elastic force in a direction opposite to a direction in which the arms approach each other to enable muscular strength enhancing exercise.

2. Discussion of Related Art

Generally, a hand gripper is a sporting apparatus used to train muscular strength of a hand or forearm and has advantages of being small in size and easy to handle and carry so it can be easily used anytime or anywhere.

A user grips a hand gripper with one hand and performs repetitions of a press action to allow a pair of operating arms to approach each other and a release action to remove force. In this case, by repeatedly applying a force to overcome elastic force provided by a spring to the hand or arm, muscular strength of the hand or arm may be improved.

As an example of the conventional hand gripper, a hand gripper which includes a pair of arms (i.e., left and right arms) and a spring of which both ends are respectively fixed to the left and right arms and a central portion is wound with a coil is known. Such a known hand gripper has a disadvantage in that it is impossible to change the strength of the hand gripper, that is, the strength of elastic force provided by the spring, because the strength of the elastic force provided by the spring is constant.

In order to address the above disadvantage of the conventional hand gripper, a hand gripper of which the strength of elastic force is adjustable is disclosed in Korean Patent No. 0760083. The above hand gripper has an advantage in that a user can adjust the strength of elastic force according to his or her own muscular strength but has a limitation in being manufactured as a high-strength hand gripper for an athlete.

Meanwhile, in Korean Patent No. 1355679, a hand gripper which includes a first arm and a second arm and a pair of spring members provided on front and rear surfaces of the first arm and the second arm is disclosed. In the above hand gripper, since the spring members are provided on the front and rear surfaces of the arms in a symmetrical shape, it is possible to provide a high-strength elastic force. However, in such a known hand gripper, a step of adjusting elastic force is limited by the number of elastic force adjusting grooves formed in one arm. In other words, although a user requires a variety of further steps of adjusting elastic force, the above known hand gripper has a limitation in providing a variety of the steps of adjusting elastic force.

SUMMARY OF THE INVENTION

The present invention is directed to providing a hand gripper capable of providing a plurality of steps of adjusting the strength of elastic force.

The present invention is also directed to providing a hand gripper of which a grip portion gripped by a user is easily replaced.

According to an aspect of the present invention, there is provided a hand gripper including a first arm including a first body and a first grip portion, a second arm including a second body and a second grip portion, wherein an upper end portion of the second body is rotatably connected to an upper end portion of the first body, and a pair of spring members symmetrically provided on front and rear surfaces of the first and second bodies, each of the spring members including a compression spring, first spring supports and second spring supports by which the compression spring interposed therebetween is compressibly supported, a first spring member coupling shaft through which the first spring supports are connected to each other and which is supported by the first body, and a second spring member coupling shaft through which the second spring supports are connected to each other and which is supported by the second body, wherein a plurality of first elastic force adjusting grooves and a plurality of second elastic force adjusting grooves, to which the first spring member coupling shaft and the second spring member coupling shaft are selectively coupled, respectively, to adjust strength of elastic force provided by the spring members, are formed in the first body and the second body, respectively.

A through-hole through which the first spring member coupling shaft passes may be formed in the first body, and a plurality of first elastic force adjusting grooves to which the first spring member coupling shaft is coupled may be formed in an inner side surface of the through-hole.

The second elastic force adjusting grooves may be provided as a plurality of second elastic force adjusting grooves in one outer side surface of the second body opposite to the first elastic force adjusting grooves.

The second body may include front and rear connecting plates which are disposed with the upper end portion of the first body interposed therebetween, coupled to the second body, and coupled to the first body by a rotation shaft. A stopper, which is interposed between the front and rear connecting plates to be rotatably coupled by a hinge shaft and has a contact surface in contact with a contact portion on the upper end portion of the first body, may be provided on an upper surface of the second body. A plurality of stopper fixing grooves may be formed in a lower surface of the stopper, and a support member coupled to the stopper fixing groove by the elastic force of the compression spring may be disposed on an upper portion of the second body, which corresponds to the stopper fixing groove. A contact portion of the first body may include a plurality of grooves to which the contact surface of the stopper is selectively coupled.

Each of the first body and the second body may include a plate-shaped coupling portion extending downward, wherein a nut mounting groove through which a nut is mounted may be formed to pass through a surface of the coupling portion, and an incision groove connected to the nut mounting groove may be formed in an end portion of the coupling portion. Each of the first grip portion and the second grip portion may include a hollow coupling groove, into which the coupling portion is rotatably inserted and which extends in a longitudinal direction, wherein a bolt fastening hole, which is connected to the coupling groove and into which a bolt fastened to the nut is inserted, may be formed in a lower end of each of the first and second grip portions.

According to another aspect of the present invention, there is provided a hand gripper including a first arm including a first body and a first grip portion, a second arm including a second body and a second grip portion, wherein an upper end portion of the second body is rotatably connected to an upper end portion of the first body, and a pair of spring members symmetrically provided on front and rear surfaces of the first and second bodies, each of the spring members including a compression spring, first spring supports and second spring supports by which the compression spring interposed therebetween is compressibly supported, a first spring member coupling shaft through which the first spring supports are connected to each other and which is supported by the first body, and a second spring member coupling shaft through which the second spring supports are connected to each other and which is supported by the second body, wherein a through-hole is formed to pass through a surface of at least one of the first body and the second body, and a plurality of elastic force adjusting grooves to which the first spring member coupling shaft or the second spring member coupling shaft is coupled are formed in an inner side surface of the through-hole.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
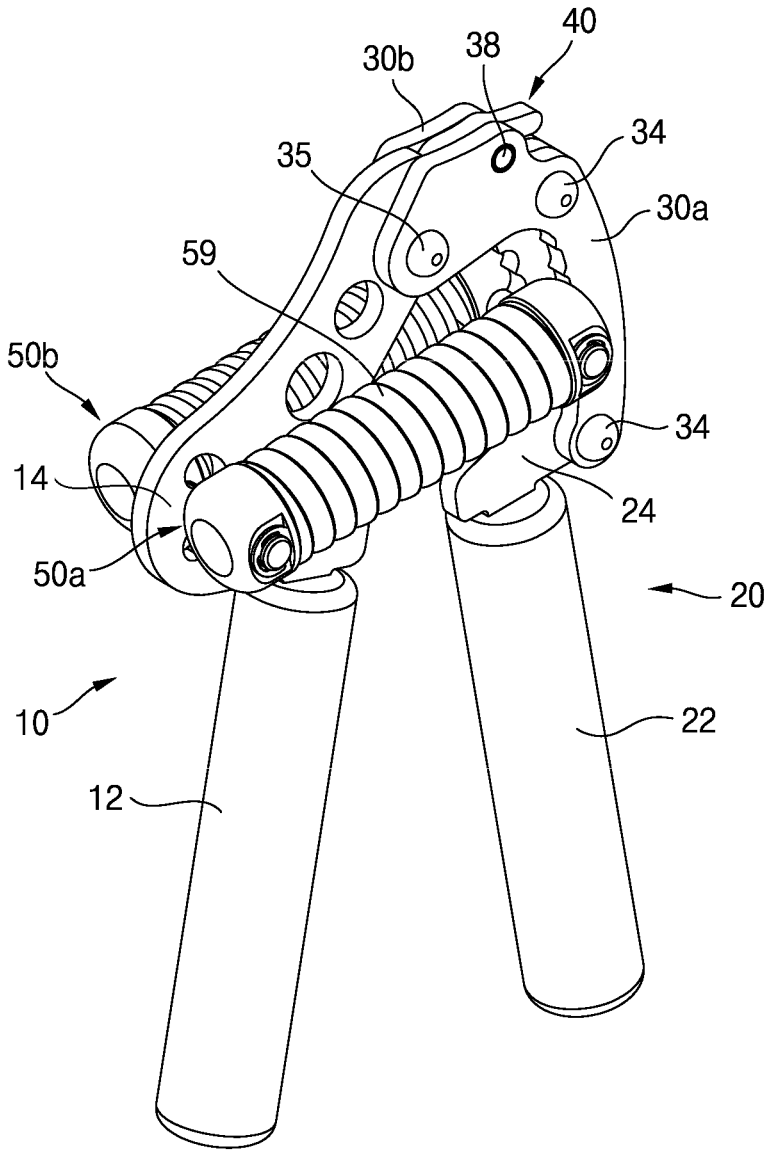
FIG. 1 is a perspective view illustrating a hand gripper according to an embodiment of the present invention.
Figure 2:
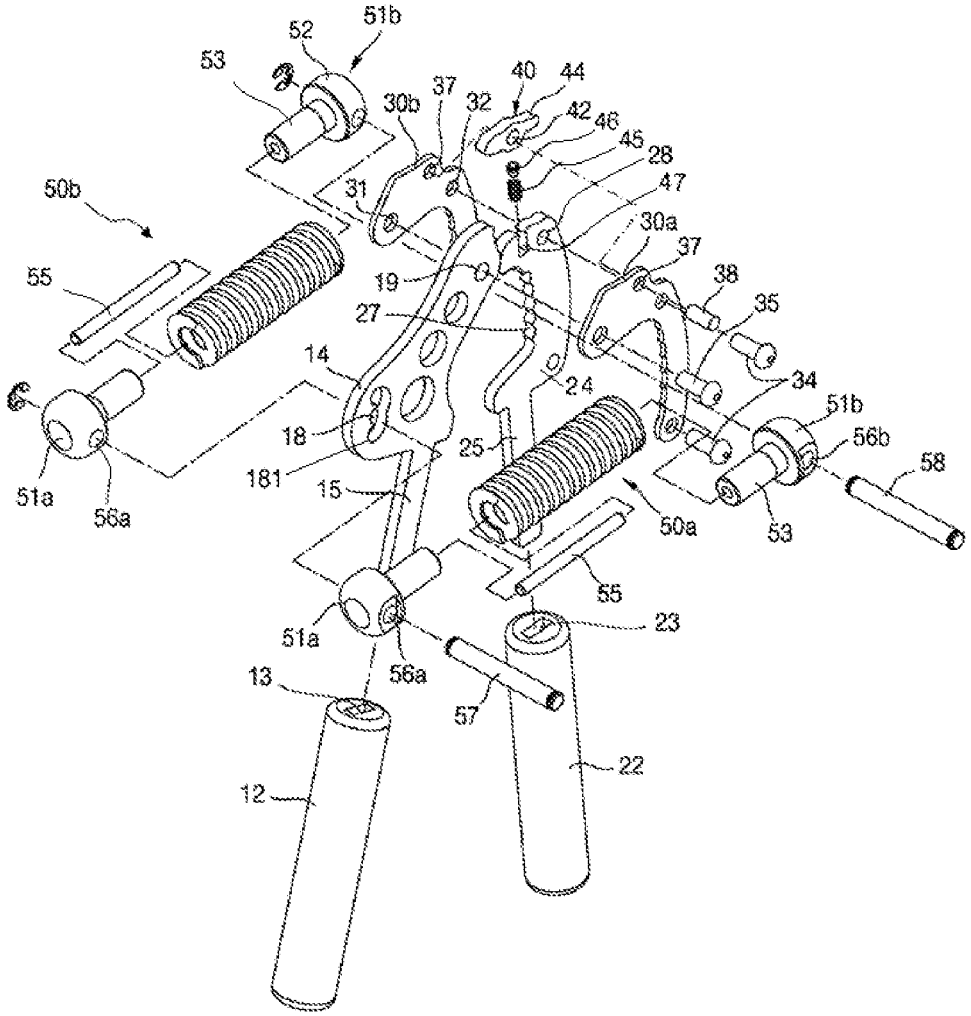
FIG. 2 is an exploded perspective view of the hand gripper illustrated in FIG. 1.
Figure 3:
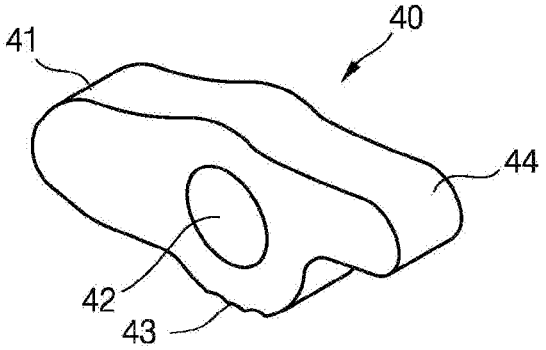
FIG. 3 is a perspective view of a stopper of the hand gripper according to the embodiment of the present invention.

While the present invention is susceptible to various modifications and alternative forms, specific embodiments thereof are shown by way of example in the accompanying drawings and will herein be described in detail. It should be understood, however, that there is no intent to limit the present invention to the particular forms disclosed, but on the contrary, the present invention is to cover all modifications, equivalents, and alternatives falling within the spirit and scope of the present invention. Like numbers refer to like elements throughout the description of the figures.

Terms are only used to distinguish one element from another element. The terminology used herein is for the purpose of describing particular embodiments only and is not intended to be limiting to the present invention. As used here, the singular forms "a" and "an" are intended to include plural forms as well unless the context clearly indicates otherwise.

Hereinafter, embodiments of the present invention will be described in detail with reference to the accompanying drawings.

A hand gripper according to an embodiment of the present invention includes a pair of operating arms including a first arm 10 and a second arm 20 which are respectively provided on left and right sides, and a pair of spring members 50*a* and 50*b* which are symmetrically provided on front and rear surfaces of the operating arms and connected to each other.

An upper end portion of the first arm 10 and an upper end portion of the second arm 20 are rotatably connected to each other so that the first arm 10 and the second arm 20 may approach each other or may be spaced apart from each other.

The first arm 10 includes a first grip portion 12 forming a lower portion thereof, and a first body 14 forming an upper portion thereof. According to the embodiment of the present invention, the first grip portion 12 and the first body 14 are combined to form the first arm 10. However, the embodiment of the present invention does not preclude the first grip portion 12 and the first body 14 from being integrally formed.

According to the embodiment of the present invention, the first grip portion 12 is formed as a cylindrical rod having a coupling groove 13 formed in a central portion thereof in a longitudinal direction. The coupling groove 13 is formed so that a coupling portion 15 is fixedly fitted thereto. The first grip portion 12 may be formed as a metal rod.

The first body 14 is formed as a plate-shaped member. According to the embodiment of the present invention, the first body 14 may be manufactured by performing laser processing or press processing on a plate member made of a metal material. The coupling portion 15, which is fixedly fitted to the coupling groove 13 of the first grip portion 12, may be formed on a lower end portion of the first body 14. The first body 14 has a shape extending to be bent toward one side, that is, toward a second body 24.

A rotation shaft coupling hole 19 is formed to pass through an upper end portion of the first body 14 in a front-rear direction, and a rotation shaft 35 is fixed to the rotation shaft coupling hole 19.

An arc-shaped slide surface 16 having a center at which the rotation shaft coupling hole 19 is located is formed on a right upper surface of the first body 14. A contact portion 17 including a plurality of grooves which are brought into contact with a stopper 40 is formed on an upper portion of the slide surface 16.

The first body 14 is disposed between the spring members 50*a* and 50*b* which are provided on the front and rear surfaces of the arms, and a through-hole 18 is formed in a surface of a left side of the first body 14. A first spring member coupling shaft 57 through which first spring supports 51*a* of the spring members 50*a* and 50*b* located on the front and rear surfaces are connected to each other extends through the through-hole 18. The first spring supports 51*a* are connected by the first spring member coupling shaft 57 with the first body 14 interposed therebetween. According to the present invention, a plurality of first elastic force adjusting grooves 181 are formed in the through-hole 18. For example, according to the embodiment illustrated in the drawings, the plurality of first elastic force adjusting grooves include three first elastic force adjusting grooves 181*a*, 181*b*, and 181*c* (see FIG. 9). However, the present invention is not limited by the number of first elastic force adjusting grooves 181.

The first elastic force adjusting grooves 181 are provided with a plurality of first elastic force adjusting grooves 181 in an inner side surface of the through-hole 18 formed in the first body 14 in a vertical longitudinal direction to have a semi-circular cross-sectional shape. The inner side surface of the through-hole 18 in which the first elastic force adjusting grooves 181 are formed is a side surface opposite to second elastic force adjusting grooves 27.

The second arm 20 includes a second grip portion 22 forming a lower portion thereof and a second body 24 forming an upper portion thereof.

The second body 24 is formed of a material, i.e., a plate-shaped member, which is the same as that of the first body 14. That is, the second body 24 may be manufactured by performing laser processing or press processing on a plate member made of a metal material. A coupling portion 25, which is fixedly fitted to a coupling groove 23 of the second grip portion 22, may be formed on a lower end portion of the second body 24. The second body 24 has a shape extending upward to correspond to the first body 14.

A corresponding slice surface 26, which has a shape, i.e., a concave arc shape, corresponding to and engaged with the slide surface 16 of the first body 14 to be movable in a sliding rotational manner, is formed on a left upper surface of the second body 24. Accordingly, sliding movement also occurs between the slide surface 16 and the corresponding slice surface 26 when the first arm 10 and the second arm 20 are rotated about the rotation shaft 35, and thus an action force is dispersed. Therefore, unlike the method in which the arms are supported only by the rotation shaft 35, there is no problem of damage even when high-strength elastic force is applied.

The second body 24 includes a front connecting plate 30*a* and a rear connecting plate 30*b* which are respectively disposed on a front surface and a rear surface of the second body 24. According to the embodiment of the present invention, the front connecting plate 30*a* and the rear connecting plate 30*b* may be manufactured by performing laser processing or press processing on a plate member made of a metal material. The front connecting plate 30*a* and the rear connecting plate 30*b* may be symmetrically formed and fixed to the second body 24.

The front and rear connecting plates 30*a* and 30*b* are fixed to the second body 24 by fixing members 34 which pass through connection plate fixing holes 28 of the second body 24 and bind the front and rear connecting plates 30*a* and 30*b*. Fixing holes 32 are formed in each of the front and rear connecting plates 30*a* and 30*b* at positions corresponding to the connection plate fixing holes 28 for fastening of the fixing members 34.

Each of the front and rear connecting plates 30*a* and 30*b* may have an upper end portion extending leftward to the first body 14, and the upper end portion of the first body 14 may be interposed between the upper end portions of the front and rear connecting plates 30*a* and 30*b*. A corresponding rotation shaft coupling hole 31 is formed in each of the front and rear connecting plates 30*a* and 30*b* to correspond to the rotation shaft coupling hole 19 of the first body 14, and the first body 14 is rotatably coupled to the front and rear connecting plates 30*a* and 30*b* by the rotation shaft 35 by which the rotation shaft coupling hole 19 and the corresponding rotation shaft coupling holes 31 are fastened in an integrated state. Accordingly, the first body 14 and the second body 24 are rotatably connected.

The second body 24 has the plurality of second elastic force adjusting grooves 27 having a semi-circular cross-sectional shape which are formed in a left outer side surface facing the first body 14 in the longitudinal direction. The second elastic force adjusting grooves 27 are formed in a side surface of the second body 24 opposite to the first body 14 in a direction corresponding to the first elastic force adjusting grooves 181.

According to the embodiment of the present invention, the first body 14, the second body 24, and the front and rear connecting plates 30*a* and 30*b* are formed of a plate-shaped member, which is cut and manufactured by performing laser processing or press processing on a plate member made of a metal material, and are coupled to each other. Therefore, mold production is unnecessary and thus a production cost may be lowered and production is facilitated.

Further, since the portions which are brought in direct contact with the spring members may be formed of a metal material, it is possible to provide a support force required in a high-strength hand gripper. Therefore, it is possible to prevent the first and second arms 10 and 20 from being damaged by the elastic force provided by the spring members 50*a* and 50*b* while manufacturing is facilitated.

According to the present invention, the stopper 40 is disposed on the upper surface of the second body 24. The stopper 40 is interposed between the front connecting plate 30*a* and the rear connecting plate 30*b* and is rotatably coupled by a hinge shaft 38. To this end, hinge holes 37 and 42 for insertion and engagement of the hinge shaft 38 are formed in the front and rear connecting plates 30*a* and 30*b* and the stopper 40.

A contact surface 41 protruding toward the first body 14 is formed on a left end of the stopper 40, and an adjusting piece 44 is formed to protrude toward a right end of the stopper 40. The contact surface 41 of the stopper 40 may be brought into contact with the contact portion 17 formed on the right upper surface of the first body 14. Here, the contact portion 17 may include a plurality of grooves to which the protruding contact surface 41 of the stopper 40 may be selectively coupled. The adjusting piece 44 is used to rotate the stopper 40 about the hinge shaft 38.

A plurality of stopper fixing grooves 43 are formed in a lower portion of the stopper 40. A spring groove 47 is formed in an upper portion of the second body 24 at a corresponding position of the stopper fixing groove 43, and a compression spring 45 and a support member 46 are provided in the spring groove 47. The support member 46 is brought into contact with the stopper fixing groove 43 by elastic force of the compression spring 45. Therefore, the support member 46 may protrude upward from the second body 24 to support the stopper 40 at a selected position while fixing the stopper fixing groove 43 of the stopper 40.

According to the embodiment of the present invention, the stopper 40 may adjust a degree of being spaced apart of the first arm 10 from the second arm 20, that is, adjust a distance between the first arm 10 and the second arm 20 in a released state in which a force is not applied to the first and second arms 10 and 20. When the user allows the first and second arms 10 and 20 to approach each other by applying a force to the first and second arms 10 and 20 and then removes the force, the first and second arms 10 and 20 are rotated in a direction away from each other about the rotation shaft 35 by the elastic force of the spring members 50*a* and 50*b*, and when the first and second arms 10 and 20 are opened over a predetermined range, the contact portion 17 of the first arm 10 and the contact surface 41 of the stopper 40 are brought into contact with each other so that the rotation of the first arm 10 relative to the second arm 20 is limited. In other words, the first arm 10 and the second arm 20 may be rotated relative to each other only up to a position at which the contact portion 17 of the first arm 10 the contact surface 41 of the stopper 40 are brought into contact with each other. The position of the stopper 40 at this time becomes a rotation limit position.

According to the embodiment of the present invention, the stopper 40 may have a plurality of fixed positions within the rotation limit position by the coupling of the stopper fixing groove 43 formed on the lower surface and the support member 46 supported by and the compression spring 45, and the contact surface 41 of the stopper 40 may be selectively coupled to any one of the plurality of grooves of the contact portion 17 at a fixed position. Therefore, the stopper 40 may adjust the degree of opening of the first arm 10 and the second arm 20, that is, adjust the distance between the first arm 10 and the second arm 20 in the released state.

Meanwhile, after the user allows the first and second arms 10 and 20 to approach each other by applying the force (see FIG. 6), the user may press the adjusting piece 44 of the stopper 40 to rotate the contact surface 41 of the stopper 40 in a clockwise direction about the hinge shaft 38 up to a position at which the contact surface 41 of the stopper 40 deviates from the rotation limit position that can limit the rotation and is brought into contact with the contact portion 17. In this case, since the contact surface 41 located at the left end of the stopper 40 deviates from its original position, the movement of the first arm 10 is not limited to a predetermined range. Therefore, the first and second arms 10 and 20 may be rotated relative to each other so as to be spaced apart from each other up to a position at which the elastic force by the spring members 50*a* and 50*b* does not act. The position of the stopper 40 at this time becomes an adjusted position. Since the spring members 50*a* and 50*b* are in a no-load state at the adjusted position, the strength of the elastic force may be adjusted by change the positions of the spring members 50*a* and 50*b*. When the adjustment of the strength of the elastic force is completed, the stopper 40 is returned to its original position while the first and second arms 10 and 20 are closed.

As described above, according to the embodiment of the present invention, the stopper may be rotated between the rotation limit position at which the degree of opening may be adjusted and the adjusted position at which the elastic force may be adjusted. In addition, the stopper may have the plurality of fixed positions within the rotation limit position so that the distance between the first and second arms in the released state may be adjusted. The method of adjusting the strength of the elastic force of the spring members 50*a* and 50*b* will be described below in more detail.

According to the present invention, the pair of spring members 50*a* and 50*b*, which are symmetrically provided on the front and rear surfaces of the first body 14 and the second body 24 of the first arm 10 and the second arm 20 and connected to each other, are provided.

Each of the spring members 50*a* and 50*b* includes a compression spring 59, and first and second spring supports 51*a* and 51*b*, by which the compression spring 59 interposed therebetween is compressibly supported and which are located at both ends of the compression spring 59.

Each of the first and second spring supports 51*a* and 51*b* includes a contact support 52 to which an end of the compression spring 59 is supported to be in contact therewith, and a guide 53 extending in an inner side direction of the compression spring 59.

Figure 4:
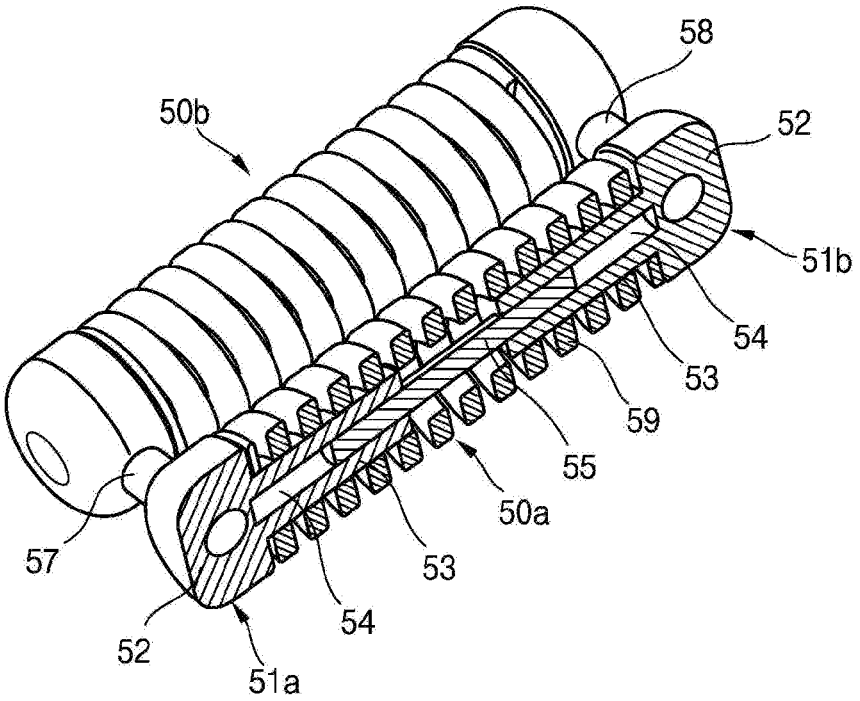
FIG. 4 is a view for describing spring members of the hand gripper according to the embodiment of the present invention.

As illustrated in FIG. 4, a guide groove 54 is formed in the guide 53 in the longitudinal direction so that a guide rod 55 is slidably inserted into the guide groove 54. Therefore, a longitudinal compression or release action of the compression spring 59 may be guided between the first and second spring supports 51*a* and 51*b*.

In the embodiment illustrated in the drawings, the guide rod 55 is illustrated as being formed separately so that both ends thereof are inserted into the guide grooves 54 on both sides. However, the guide rod 55 may be formed to be integrally coupled with the guide 53 on one side.

According to the present invention, the pair of spring members 50*a* and 50*b* are connected to each other by the first spring member coupling shaft 57 and the second spring member coupling shaft 58 and are integrally operated. Through-holes 56*a* and 56*b* are respectively formed in the first and second spring supports 51*a* and 51*b* of the spring members 50*a* and 50*b* in the front-rear direction so that the first and second spring member coupling shafts 57 and 58 are coupled to the through-holes 56*a* and 56*b*, respectively.

In the case of the coupling of the first spring supports 51*a*, in a state in which the first spring supports 51*a* are respectively disposed on the front and rear surfaces of the first body 14 of the first arm 10, the first spring member coupling shaft 57 passes through the through-hole 18 of the first body 14 and the through-hole 56*a* of the first spring supports 51*a* to be fixedly inserted. The first spring member coupling shaft 57 may be coupled to any one of the plurality of first elastic force adjusting grooves 181 formed in the through-hole 18.

The second spring supports 51*b* may also be coupled to each other by the second spring member coupling shaft 58 inserted through the through-hole 56*b*. The second spring supports 51*b* are disposed with the second body 24 interposed therebetween, and the second spring member coupling shaft 58 may be coupled to any one of the second elastic force adjusting grooves 27.

A process of adjusting the elastic force of the hand gripper according to the present invention will be described with reference to FIGS. 5 and 6.

Figure 5:
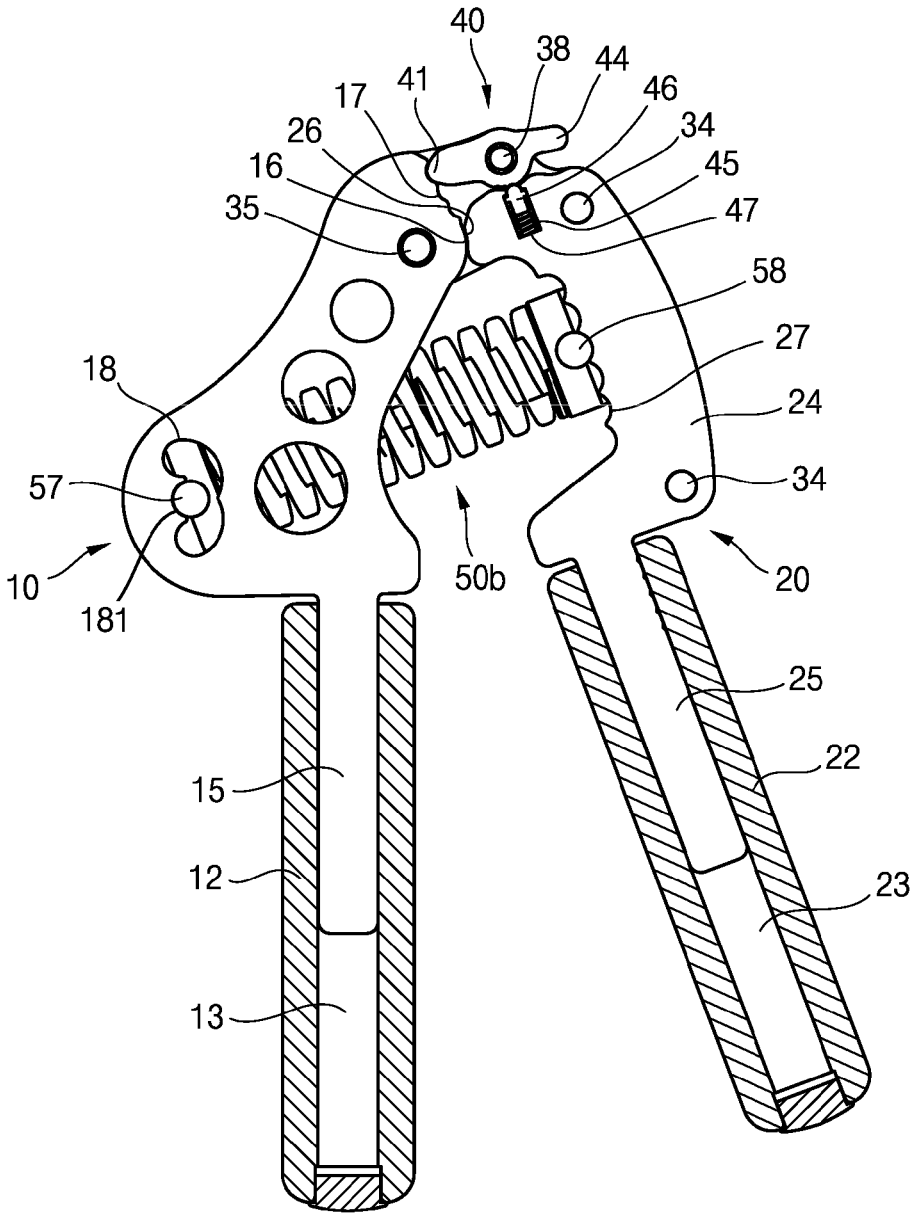
FIG. 5 is a cross-sectional view of a coupling structure of the hand gripper according to the embodiment of the present invention.

FIG. 5 shows a released state in which the user does not apply a force to the arms of the hand gripper. The stopper 40 is located at the rotation limit position at which the contact surface 41 may be brought into contact with the contact portion 17 of the first arm 10 so that a spaced distance between the first arm 10 and the second arm 20 is limited. The spaced distance is determined by any groove among the plurality of grooves of the contact portion 17, which is brought into contact with the contact surface 41 of the stopper 40.

Figure 6:
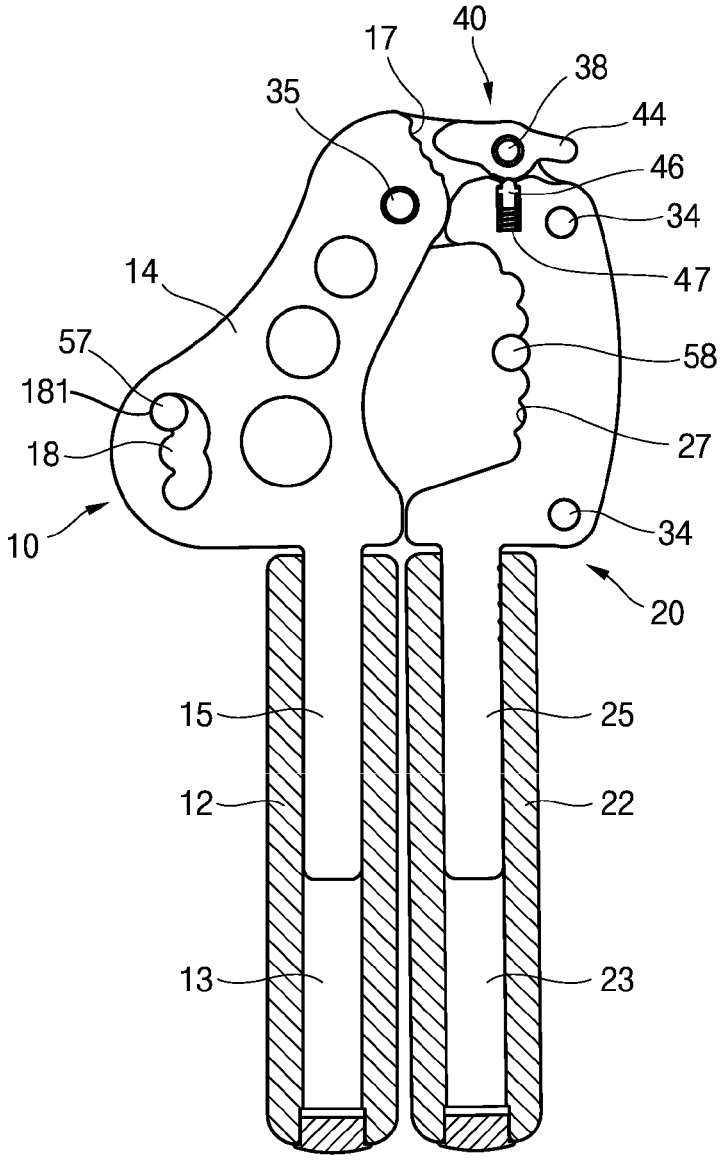
FIG. 6 is a cross-sectional view illustrating a state in which a first arm and a second arm of the hand gripper approach each other as much as possible according to the embodiment of the present invention.

FIG. 6 is a cross-sectional view illustrating a state in which the user applies a force to the arms of the hand gripper so that the first and second arms 10 and 20 approach each other as much as possible. It can be seen that the position of the stopper 40 may be adjusted by rotating the stopper 40 about the hinge shaft 38 in comparison to the case in FIG. 5. In the state of FIG. 6, in order to adjust the strength of the elastic force, first, the adjusting piece 44 of the stopper 40 is pressed so that the stopper 40 is rotated in a clockwise direction about the hinge shaft 38. Accordingly, the stopper 40 may be rotated to a position at which the contact surface 41 of the stopper 40 is not brought into contact with the contact portion 17 of the first body 14.

In the adjusted position state, the left end contact surface 41 of the stopper 40 deviates from the position of being in contact with the contact portion 17 of the first body 14, and thus the first arm 10 is allowed to be rotated relative to the second arm 20 up to a position at which no elastic force is applied. The spring members 50*a* and 50*b* are in a no-load state in which no elastic force is applied so that the first and second spring member coupling shafts 57 and 58 are freely separated from the first and second elastic force adjusting grooves 181 and 27. Accordingly, the left and right spring member coupling shafts 57 and 58 may be set to be located at any desired positions of the corresponding first and second elastic force adjusting grooves 181 and 27. In this case, the through-hole 18 prevents the spring members 50*a* and 50*b* from being fully separated, and thus the positions of the spring members 50*a* and 50*b* may be easily adjusted.

The first and second spring member coupling shafts 57 and 58 are moved to any desired positions of the corresponding first and second elastic force adjusting grooves 181 and 27, respectively, and then the first and second arms 10 and 20 are closed again and the stopper 40 is returned to the rotation limit position, and thus the adjustment of the elastic force is completed.

Hereinafter, a hand gripper according to another embodiment of the present invention will be described with reference to FIGS. 7 and 8. In the following description of the hand gripper according to another embodiment of the present invention, the same numerals are assigned to the same components and to the components having the same functions as those of one embodiment of the present invention, and detailed descriptions of these components are omitted to avoid repetitive configurations.

The hand gripper according to another embodiment of the present invention has a coupling structure of first and second bodies 14 and 24 and first and second grip portions 12 and 22 different from that in one embodiment.

Figure 7:
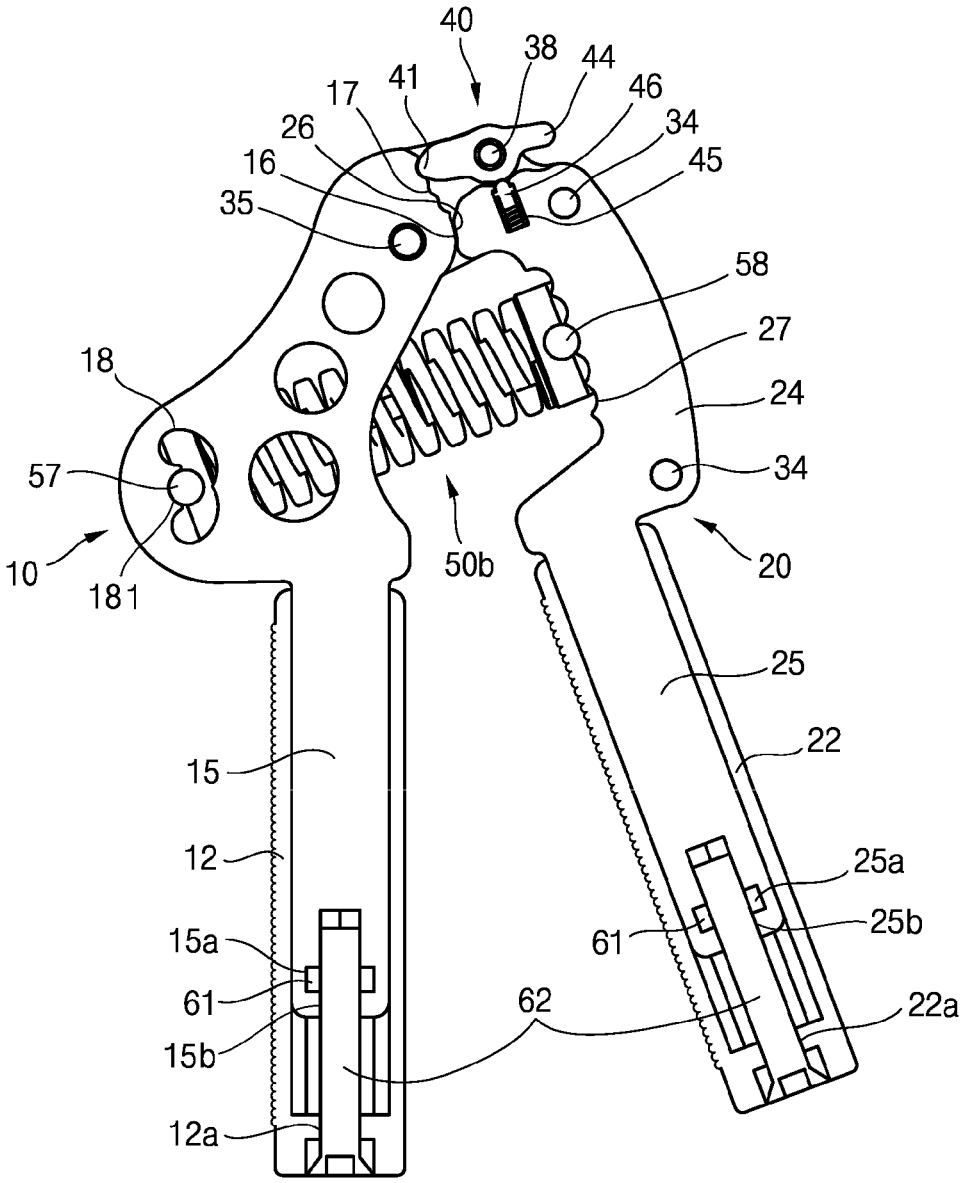
FIGS. 7 and 8 are a cross-sectional view of a coupling structure of a hand gripper and an exploded perspective view of the hand gripper according to another embodiment of the present invention.
Figure 8:
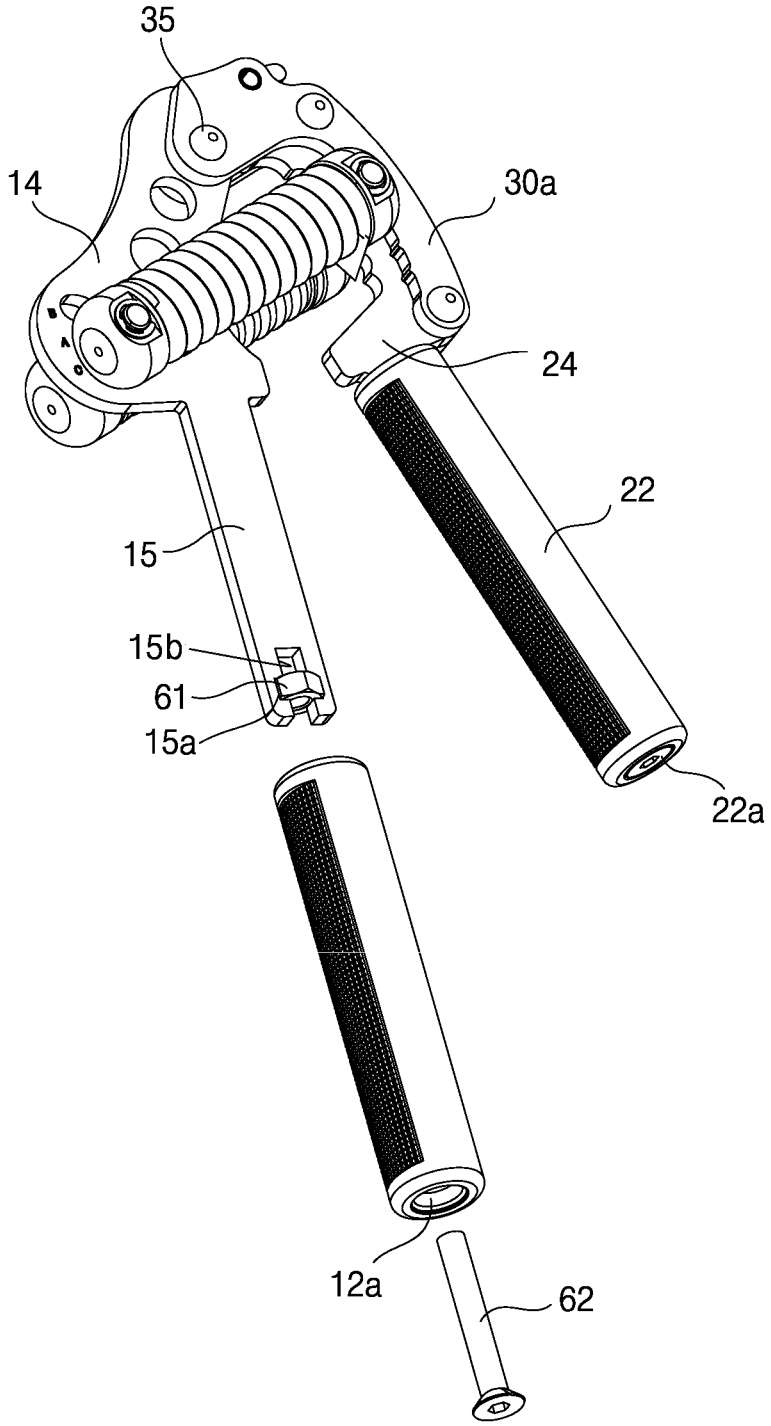

FIG. 7 is a cross-sectional view illustrating a coupling structure of first and second grip portions of the hand gripper according to another embodiment of the present invention, and FIG. 8 is an exploded perspective view for describing a process of coupling the first and second grip portions of the hand gripper according to another embodiment of the present invention.

According to another embodiment of the present invention, nut mounting grooves 15*a* and 25*a* in which nuts 61 are mounted are formed in end portions of coupling portions 15 and 25 which are provided as lower portions of first and second bodies 14 and 24. The coupling portions 15 and 25 are formed as portions of the first and second bodies 14 and 24 in a plate shape. The nut mounting grooves 15*a* and 25*a* are formed to pass through surfaces of the coupling portions 15 and 25 formed in the plate shape, and incision grooves 15*b* and 25*b* that extend to cross the nut mounting grooves 15*a* and 25*a* in a longitudinal direction are formed in the end portions of the coupling portions 15 and 25. The incision grooves 15*b* and 25*b* allow the end portions of the coupling portions 15 and 25 to be opened and thus facilitate the mounting of the nuts 61 and allow bolts 62 to be fastened to the nuts 61.

The first and second grip portions 12 and 22 include hollow coupling grooves 13 and 23 in a cylindrical shape, respectively, and hollow bolt fastening holes 12*a* and 22*a* to which the bolts 62 are fastened are respectively formed in lower ends of the first and second grip portions 12 and 22 and connected to the coupling grooves 13 and 23. Since the coupling grooves 13 and 23 allow the coupling portions 15 and 25 to be rotated, it is possible to adjust positions of the first and second grip portions 12 and 22. The bolts 62 may be round-head bolts, and heads of the bolts may be formed to have a diameter greater than that of each of the bolt fastening holes 12*a* and 22*a* so that the first and second grip portions 12 and 22 may be firmly fixed to the coupling portions 15 and 25.

Protrusions are formed on grip surfaces of the first and second grip portions 12 and 22 such that the hand does not slip during exercise, but the protrusions may cause pain in the gripped hand. In the present invention, in order to resolve the above disadvantage, the user may easily replace the grippable first and second grip portions 12 and 22 and may also selectively adjust the grip surfaces of the first and second grip portions 12 and 22 by making the first and second grip portions 12 and 22 rotatable. Therefore, ease of use can be improved by suppressing the induction of hand pain.

Figure 9:
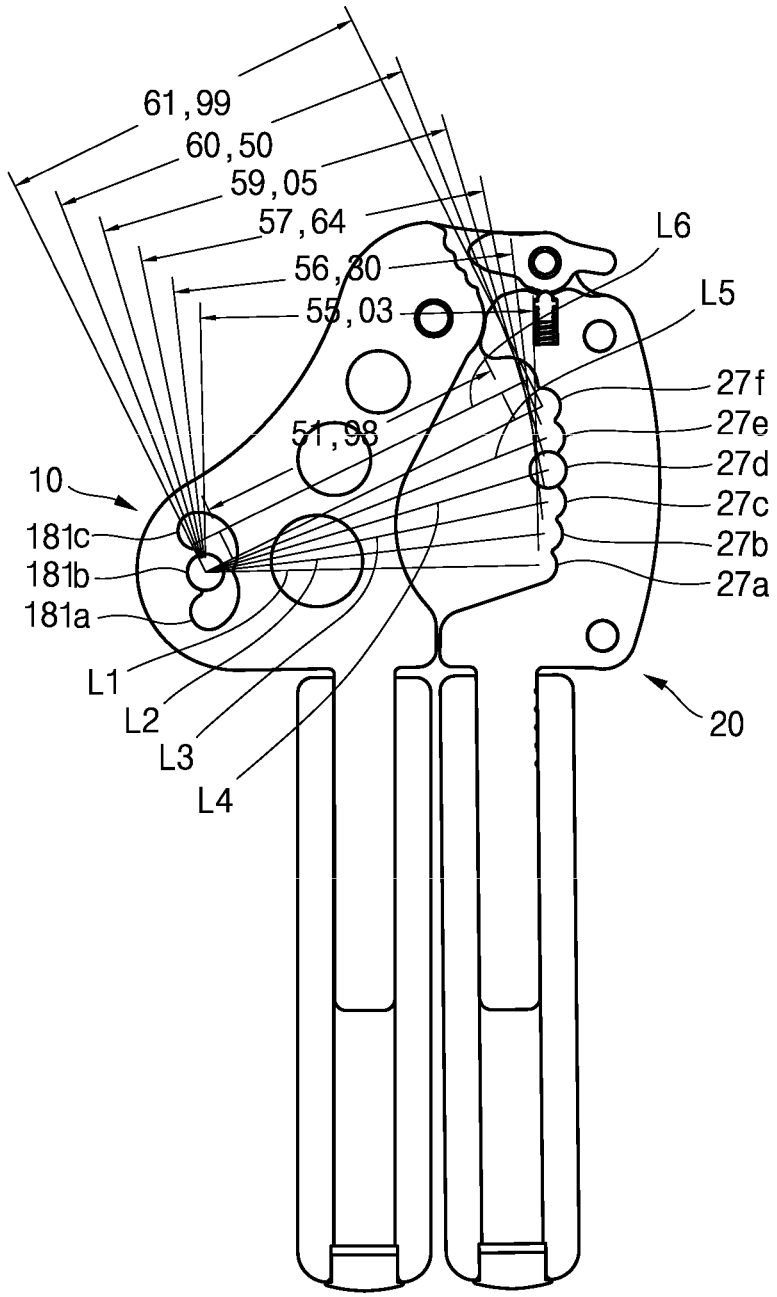
FIGS. 9 to 11 are cross-sectional views for describing adjustment of the strength of elastic force according to adjustment of a position of the spring member in the hand gripper according to the embodiment of the present invention.
Figure 10:
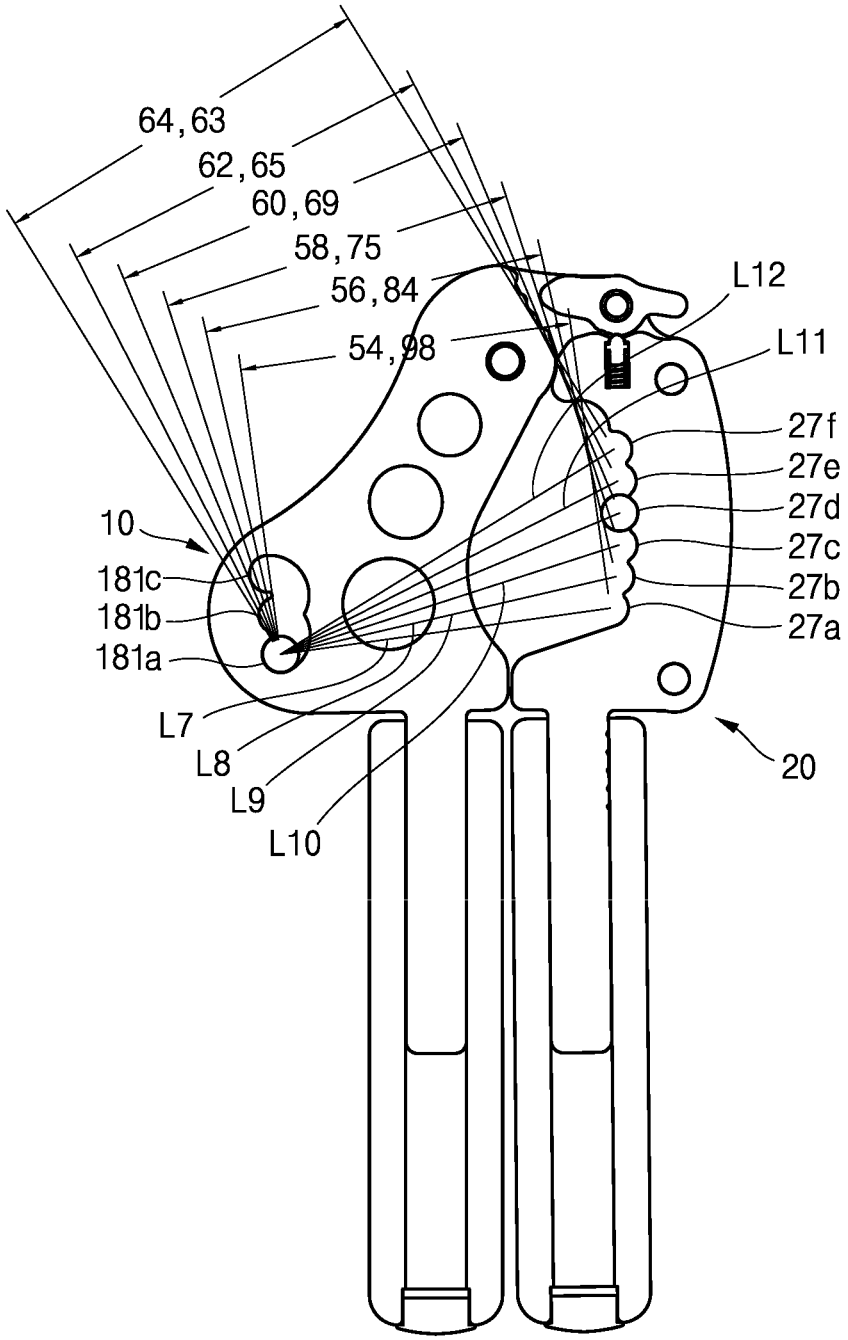
Figure 11:
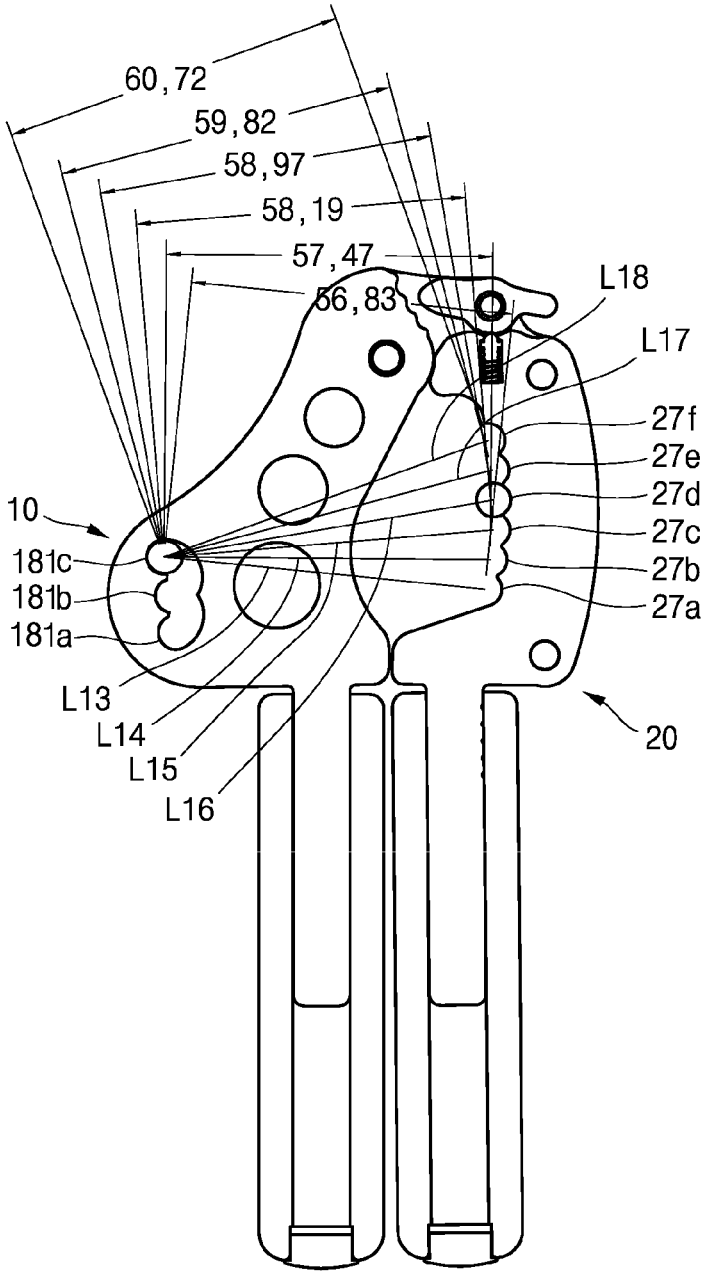

FIGS. 9 to 11 are cross-sectional views for describing a change in strength of the elastic force according to a change in positions of the spring members 50*a* and 50*b* in the hand gripper according to the embodiment of the present invention.

In the hand gripper according to the embodiment of the present invention, the strength of the elastic force may be adjusted by the number of the first and second elastic force adjusting grooves 181 and 27. As illustrated in the drawings, when each of the first and second spring member coupling shafts 57 and 58 is located in a corresponding one of first and second elastic force adjusting grooves 181*a*, 181*b*, 181*c*, 27*a*, 27*b*, 27*c*, 27*d*, 27*e*, and 27*f*, elastic force operating lines L1 to L18 due to the spring members 50*a* and 50*b* are formed.

FIGS. 9 and 10 illustrate a corresponding relationship between cases in which the first spring member coupling shaft 57 is located in each of the first elastic force adjusting grooves 181*b*, 181*c*, and 181*a* and cases in which the second spring member coupling shaft 58 is located in each of the second elastic force adjusting grooves 27*a*, 27*b*, 27*c*, 27*d*, 27*e*, and 27*f*. In order to exemplarily illustrate a change in length of the spring members 50*a* and 50*b* according to a change in positions of the first and second spring member coupling shafts 57 and 58, a length (e.g., "61, 99" refers to 61.99 mm) is indicated on each of the operating lines. As the elastic force operating line is changed, a distance from the rotation shaft 35 is changed and the strength of the elastic force is also changed.

As illustrated in FIGS. 9 and 10, in the hand gripper according to the embodiment of the present invention, the first spring member coupling shaft 57 may be selectively coupled to the plurality of first elastic force adjusting grooves 181 and the second spring member coupling shaft 58 may be selectively coupled to the plurality of second elastic force adjusting grooves 27, and thus various steps of adjusting the strength of the elastic force may be provided. For example, in the embodiment illustrated in FIGS. 9 and 10, three first elastic force adjusting grooves and six second elastic force adjusting grooves are provided, and thus the strength of the elastic force may be adjusted in 18 steps. The number of the steps of adjusting the strength of the elastic force may increase or decrease depending on the number of the first and second elastic force adjusting grooves 18 and 27.

In the hand gripper having the above-described configuration, there are various cases in the pair of spring members 50*a* and 50*b* depending on combination conditions of the positions at which the first and spring member coupling shafts 57 and 58 that support to be integrally operated are inserted into the plurality of first and second elastic force adjusting grooves 181 and 27. Therefore, it is possible to finely adjust the strength of the hand gripper in several steps according to the user's muscular strength.

Since the pair of spring members 50*a* and 50*b* are provided on the front and rear surfaces of the first and second arms 10 and 20, the strength of the elastic force may be significantly increased and the strength of the elastic force may be adjusted in various steps. In the hand gripper, the elastic force provided by the springs depends on the thickness, winding diameter, and length of a spring wire of the spring. Because the spring members 50*a* and 50*b* are located outside the first arm and the second arm, there is no interference with other components, and thus the thickness, winding diameter, and length of the spring wire may be adjusted according to the designed strength.

In addition, the user may easily replace the gripping first and second grip portions 12 and 22 and may selectively adjust the grip surfaces of the first and second grip portions 12 and 22 by making the first and second grip portions 12 and 22 rotatable. Therefore, the ease of use can be improved.

According to the hand gripper of the present invention, the strength of the elastic force can be variously adjusted according to the positions of the spring members, and thus it is possible to easily adjust the strength of the hand gripper in several steps according to the user's muscular strength.

Further, the user can selectively adjust the grip surfaces by replacing the gripping grip portions or making the gripping grip portions rotatable, and thus the ease of use can be improved.

The above description is only exemplary, and it will be understood by those skilled in the art that the invention may be performed in other concrete forms without changing the technological scope and essential features. Therefore, the above-described embodiments should be considered as only examples in all aspects and not for purposes of limitation. The scope of the present invention is defined not by the detailed description but by the appended claims and encompasses all modifications or alterations derived from meanings, the scope and equivalents of the appended claims.

What is claimed is:

1. A hand gripper comprising:

a first arm including a first body and a first grip portion;

a second arm including a second body and a second grip portion, wherein an upper end portion of the second body is rotatably connected to an upper end portion of the first body;

a pair of spring members symmetrically provided on front and rear surfaces of the first and second bodies, each of the spring members including a first compression spring, first spring supports and second spring supports by which the first compression spring interposed therebetween is compressibly supported;

a first spring member coupling shaft through which the first spring supports are connected to each other and which is supported by the first body; and a second spring member coupling shaft through which the second spring supports are connected to each other and which is supported by the second body;

wherein a plurality of first elastic force adjusting grooves and a plurality of second elastic force adjusting grooves, to which the first spring member coupling shaft and the second spring member coupling shaft are selectively coupled, respectively, to adjust strength of elastic force provided by the spring members, are formed in the first body and the second body, respectively.

2. The hand gripper of claim 1, wherein:

a through-hole through which the first spring member coupling shaft passes is formed in the first body; and the plurality of first elastic force adjusting grooves to which the first spring member coupling shaft is coupled are formed in an inner side surface of the through-hole.

3. The hand gripper of claim 2, wherein the plurality of second elastic force adjusting grooves are provided in one outer side surface of the second body opposite to the plurality of first elastic force adjusting grooves.

4. The hand gripper of claim 1, wherein:

the second body includes front and rear connecting plates which are disposed with the upper end portion of the first body interposed therebetween, coupled to the second body, and coupled to the first body by a rotation shaft;

a stopper, which is interposed between the front and rear connecting plates to be rotatably coupled by a hinge shaft and has a contact surface in contact with a contact portion formed on the upper end portion of the first body, is provided on an upper surface of the second body;

a plurality of stopper fixing grooves are formed in a lower surface of the stopper;

a support member coupled to the stopper fixing groove by an elastic force of a second compression spring is disposed on an upper portion of the second body which corresponds to the stopper fixing groove; and a plurality of grooves are formed on the contact portion to which the contact surface of the stopper is selectively coupled.

5. The hand gripper of claim 1, wherein:

each of the first body and the second body includes a plate-shaped coupling portion extending downward, wherein a nut mounting groove through which a nut is mounted is formed to pass through a surface of the coupling portion, and an incision groove connected to the nut mounting groove is formed in an end portion of the coupling portion; and each of the first grip portion and the second grip portion includes a hollow coupling groove into which the coupling portion is rotatably inserted and which extends in a longitudinal direction, wherein a bolt fastening hole, which is connected to the coupling groove and into which a bolt fastened to the nut is inserted, is formed in a lower end of each of the first and second grip portions.

6. A hand gripper comprising:

a first arm including a first body and a first grip portion;

a second arm including a second body and a second grip portion, wherein an upper end portion of the second body is rotatably connected to an upper end portion of the first body; and a pair of spring members symmetrically provided on front and rear surfaces of the first and second bodies, each of the spring members including a first compression spring, first spring supports and second spring supports by which the first compression spring interposed therebetween is compressibly supported;

a first spring member coupling shaft through which the first spring supports are connected to each other and which is supported by the first body; and a second spring member coupling shaft through which the second spring supports are connected to each other and which is supported by the second body;

wherein a through-hole is formed to pass through a surface of at least one of the first body and the second body, and a plurality of elastic force adjusting grooves to which the first spring member coupling shaft or the second spring member coupling shaft is coupled are formed in an inner side surface of the through-hole.

* * * * *